US006764144B2

(12) United States Patent
Insalaco et al.

(10) Patent No.: US 6,764,144 B2
(45) Date of Patent: Jul. 20, 2004

(54) STORAGE UNIT

(75) Inventors: Robert W. Insalaco, Holland, MI (US); David J. Ritch, Malibu, CA (US); Mark B. Saffell, Manhattan Beach, CA (US); Gordon J. Stannis, West Olive, MI (US)

(73) Assignee: Herman Miller, Inc., Zeeland, MI (US)

( * ) Notice: Subject to any disclaimer, the term of this patent is extended or adjusted under 35 U.S.C. 154(b) by 75 days.

(21) Appl. No.: 09/975,245

(22) Filed: Oct. 10, 2001

(65) Prior Publication Data

US 2002/0043905 A1 Apr. 18, 2002

Related U.S. Application Data

(60) Provisional application No. 60/240,469, filed on Oct. 13, 2000.

(51) Int. Cl.[7] ..... A47B 87/00; A47B 47/00

(52) U.S. Cl. ..... 312/108; 312/265; 312/257.1

(58) Field of Search ..... 312/107, 108, 312/111, 257.1, 263, 265, 351; 211/182, 189, 194

(56) References Cited

U.S. PATENT DOCUMENTS

| | | | | | |
|---|---|---|---|---|---|
| 2,962,334 | A | * | 11/1960 | Dutmers | 312/108 |
| 3,730,601 | A | * | 5/1973 | Misenheimer, III | 312/108 |
| 3,822,924 | A | | 7/1974 | Lust | |
| 3,879,096 | A | * | 4/1975 | Blodee | 312/265 |
| 3,955,863 | A | * | 5/1976 | Yellin | 312/265.2 |
| 4,053,192 | A | | 10/1977 | Spetner | |
| 4,125,304 | A | * | 11/1978 | Ebert | 312/257.1 |
| 4,169,639 | A | * | 10/1979 | Zola | 312/265 |
| 4,192,562 | A | | 3/1980 | Bishoff et al. | |
| 4,269,461 | A | | 5/1981 | Roach, Jr. | |
| 4,418,627 | A | * | 12/1983 | Baker | 108/91 |
| 5,234,267 | A | * | 8/1993 | Pauer et al. | 312/140 |
| 5,383,722 | A | | 1/1995 | Chen | |
| 5,466,058 | A | * | 11/1995 | Chan | 312/111 |
| 5,810,505 | A | * | 9/1998 | Henriott et al. | 403/230 |
| 5,826,955 | A | | 10/1998 | Sanders et al. | |
| 5,975,660 | A | * | 11/1999 | Tisbo et al. | 312/263 |
| 6,099,092 | A | * | 8/2000 | Uffner et al. | 312/108 |

FOREIGN PATENT DOCUMENTS

| | | | | |
|---|---|---|---|---|
| IT | 716459 | * | 9/1972 | 312/108 |

* cited by examiner

*Primary Examiner*—James O. Hansen
(74) *Attorney, Agent, or Firm*—Brinks Hofer Gilson & Lione

(57) ABSTRACT

A storage unit includes a first and second horizontal shelf member, at least one vertical panel disposed between the first and second horizontal shelf members, and at least one tie member. A bottom of the at least one vertical panel is supported by the first shelf member and the second shelf member is supported on a top of the at least one vertical panel. The at least one tie member extends between and connects the first and second horizontal shelf members, with the at least one panel clamped therebetween. In another aspect of the invention, a method for assembling a storage unit is provided.

7 Claims, 7 Drawing Sheets

STORAGE UNIT

This application claims the benefit of U.S. Provisional Application Serial No. 60/240,469, filed Oct. 13, 2000, the entire disclosure of which is hereby incorporated herein by reference.

BACKGROUND

The present invention relates generally to a storage unit, and in particular, to a modular storage unit.

Typically, storage units, such as file cabinets and the like, are made of one or more pieces of sheet metal or wood, which pieces typically are permanently affixed together by welding and the like. Storage units of this nature are usually assembled at a manufacturer's facility by skilled workers, rather than by the end user. In addition, each storage unit is typically configured in a particular size that cannot be easily modified. As such, the storage units often require large amounts of storage space for inventory, and, due to their bulky size when assembled, can be expensive to ship. In addition, many conventional screens cannot be shipped by commercial carriers due to the relatively large size and weight of the screens. For example, United Parcel Service (UPS) has a size limitation of a 130 cumulative inches, which is defined as the circumference of the product plus the height thereof. Since many customers desire to have products shipped via such carriers, whether through orders placed on the internet or over the telephone, it can be advantageous to provide a storage unit meeting such size limitations. At the same time, many customers desire storage units that can be easily assembled without the need for special tools, and which are light weight and portable.

In addition, many conventional storage units cannot be easily reconfigured by the end user to increase or decrease the storage volume, so as to accommodate changing storage needs. Moreover, conventional storage units, such as filing cabinets, can be relatively plain in their appearance.

SUMMARY

Briefly stated, in one aspect of the invention, one embodiment of a storage unit includes a first and second horizontal shelf member, at least one vertical panel disposed between the first and second horizontal shelf members, and at least one tie member. A bottom of the at least one vertical panel is supported by the first shelf member and the second shelf member is supported on a top of the at least one vertical panel. The at least one tie member extends between and connects the first and second horizontal shelf members, with the at least one panel clamped therebetween. In another aspect of the invention, a method for assembling a storage unit is provided.

In a preferred embodiment, the at least one panel comprises a pair of side panels, and the storage unit further comprises a back panel extending between the side panels and a front panel connected to one of the side panels.

In another aspect, an alternative preferred embodiment of the storage units further includes a third shelf, at least one second panel and at least one second tie member. A bottom of the second panel is supported on the second shelf and the third shelf is supported on a top of the second panel. The second tie member extends between and connects the second and third shelf members.

In another aspect of the invention, a storage unit kit has components capable of being assembled into a storage unit. The kit includes a plurality of shelf members, a plurality of side panels, at least one back panel, a plurality of tie members and at least one front panel.

The present inventions provide significant advantages over other storage units. For example, the storage unit can be easily reconfigured by adding additional levels of storage to accommodate the user's needs. In addition, the components of the storage unit can be shipped in an unassembled state and can then be assembled by the end user so as to reduce the shipping volume and attendant expense. Preferably, such a storage unit meets the shipping requirements of various commercial carriers, like UPS. Moreover, end users can maintain a plurality of various individual components in inventory, rather than a plurality of cabinets. As such, the user can simply use the components as needed to reconfigure the various storage units. In addition, additional levels of storage can be added to the storage unit without having to disassemble already assembled lower levels. Assembly can be accomplished quickly and with minimal effort.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

The terms "front", "side", "back", "top", "bottom", "upwardly" and "downwardly" as used herein are intended to indicate the various directions and portions of the storage unit and its components as normally understood when viewed from the perspective of a user facing the storage unit.

Figure 1:
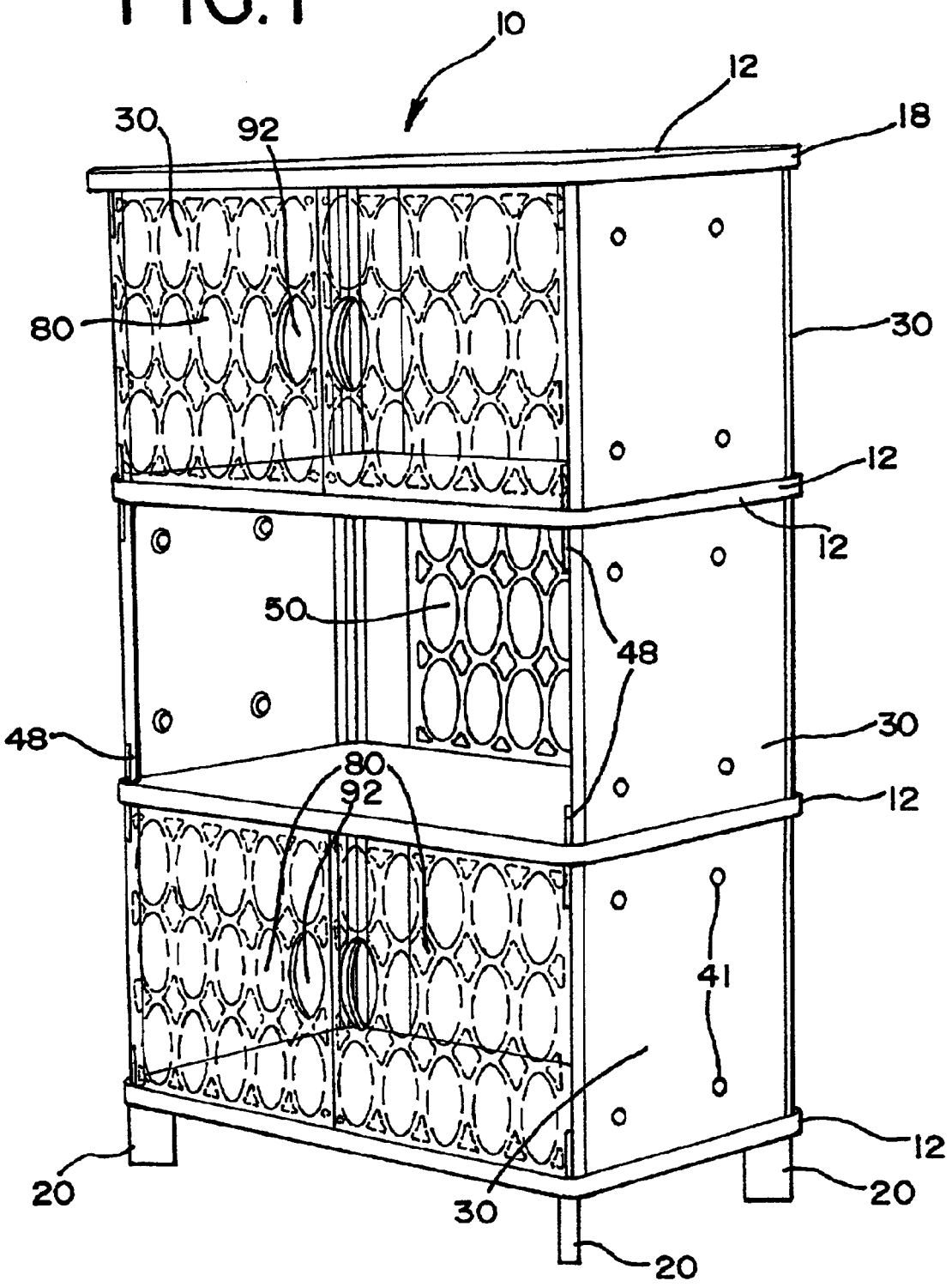
FIG. 1 is a perspective view of one embodiment of a storage unit having three levels.
Figure 2:
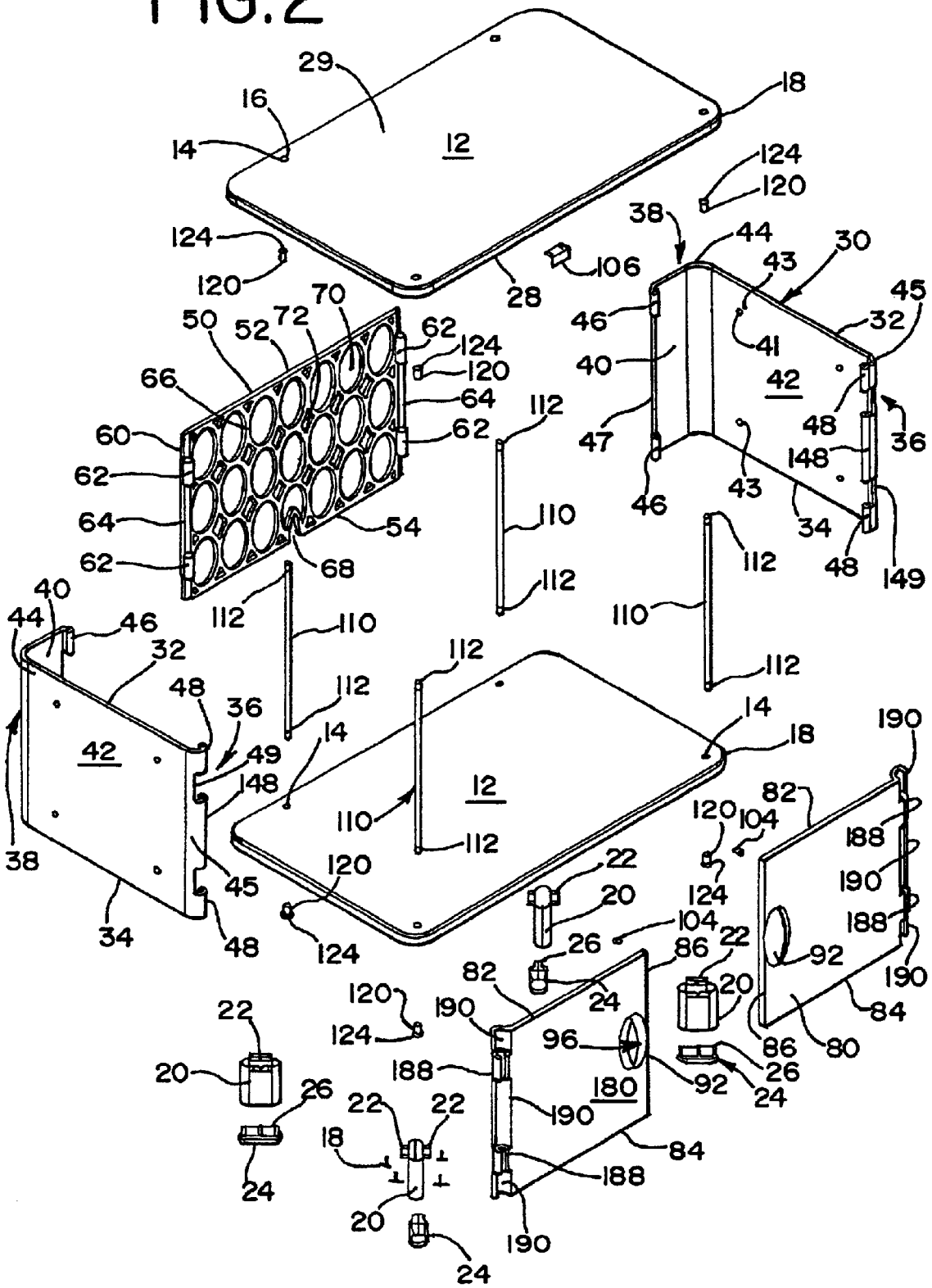
FIG. 2 is an exploded perspective view of a storage unit.

Referring to the drawings, and as best shown in FIGS. 1 and 2, a storage unit 10 can be assembled with various numbers of levels. For example, a storage unit 10 having three levels is shown in FIG. 1, while a storage unit 10 having only a single level is shown in FIG. 2. It should be understood that storage units having one or more levels can easily constructed using the components described herein below, and that the one and three level units are meant only to be exemplary and not limiting.

Referring to FIG. 2, the storage unit 10 includes a pair of shelves 12, and in particular, a lower and an upper shelf. Each shelf preferably has four holes 14 passing therethrough, with each hole preferably having a countersink 16. The shelf preferably has a rectangular shape and further preferably includes rounded corners 18. The shelf is preferably made of MDF fiber board with a clear coat of acrylic finish applied thereto, although it should be understood that other materials, including various wood, plastic and metal materials, and other finishes, including paint, laminate and melamine, would also work. The lowermost shelf is preferably flipped over such that the countersink is located on a bottom side of the shelf. The lowermost shelf 12 is further preferably configured with an additional plurality of holes, preferably four, on a bottom side thereof that are positioned and dimensioned to receive fasteners 18 that secure a support foot 20 to a bottom surface of the shelf. The support foot 20 is preferably made of sheet metal and has an elliptical cross-section with a pair of flanges extending laterally from a top of the support foot. A glide 24 is secured to the bottom of the foot, preferably with an insert portion received in an open end thereof. Preferably, the fasteners 18 secure the flanges 22 to the bottom of the shelf. Alternatively, the support foot can be configured with a caster or other type of wheel.

Referring to FIGS. 1 and 2, each level of the storage unit comprises a pair of side panels 30, a back panel 50, and a pair of front panels 80, or doors. Each of the side panels 30 comprises a top 32, a bottom 34, a front 36 and a back 38. The back of the side panel includes a back panel section 40 that extends laterally from a side panel section 42. The two sections 40, 42 are joined by a curved corner portion 44. The side and back panels sections 40, 42 in combination with the curved corner portion 44 increase the strength and rigidity of the side panel and make it more resistant to buckling and bending. Preferably, each side panel is made of sheet metal, and more preferably from a single sheet metal blank, although it should be understood that they could be made of other materials capable of absorbing a compression loading.

Figure 4:
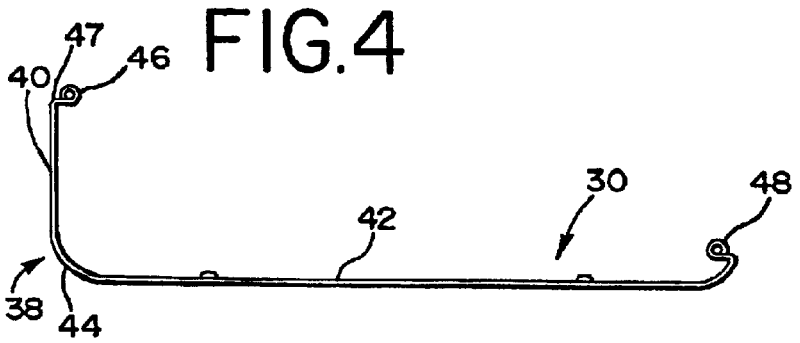
FIG. 4 is a top view of the side panel shown in FIG. 3.
Figure 3:
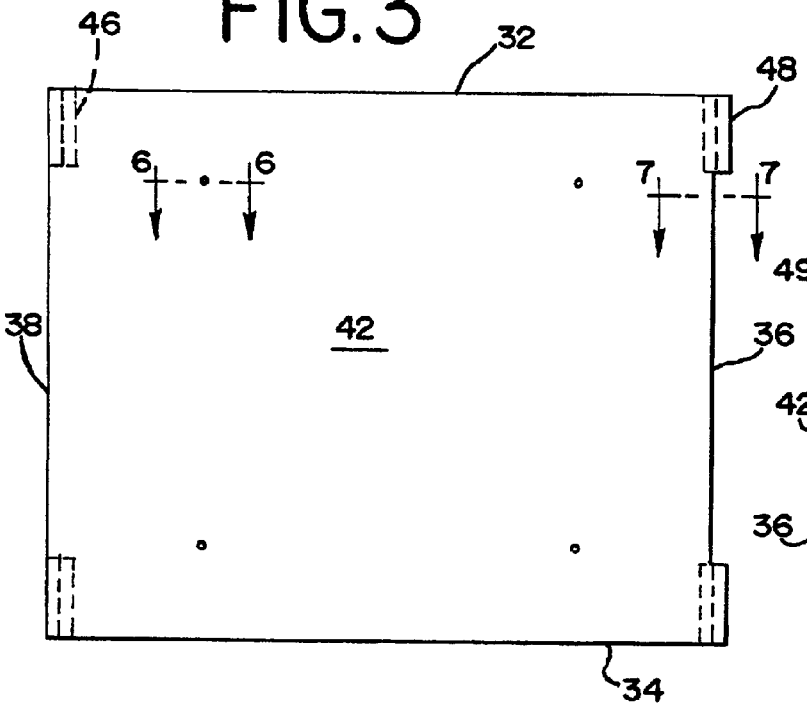
FIG. 3 is a side view of a side panel.
Figure 5:
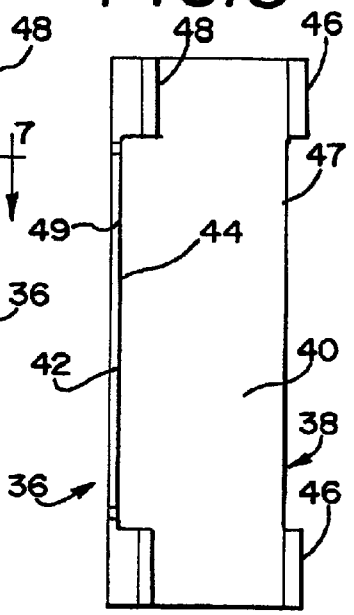
FIG. 5 is an end view of the side panel shown in FIG. 3.
Figure 6:
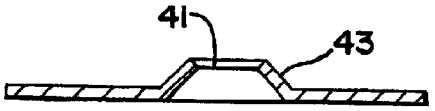
FIG. 6 is a partial cross-sectional view of the side panel taken along line 6—6 of FIG. 3.
Figure 7:
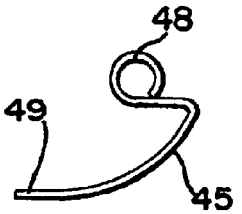
FIG. 7 is a partial cross-sectional view of the side panel taken along line 7—7 of FIG. 3.
Figure 9:
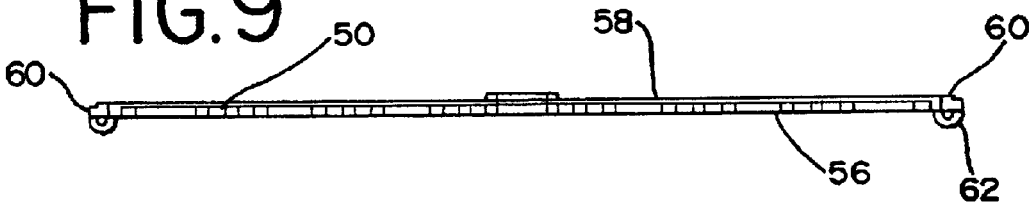
FIG. 9 is a top view of the back panel shown in FIG. 8.
Figure 8:
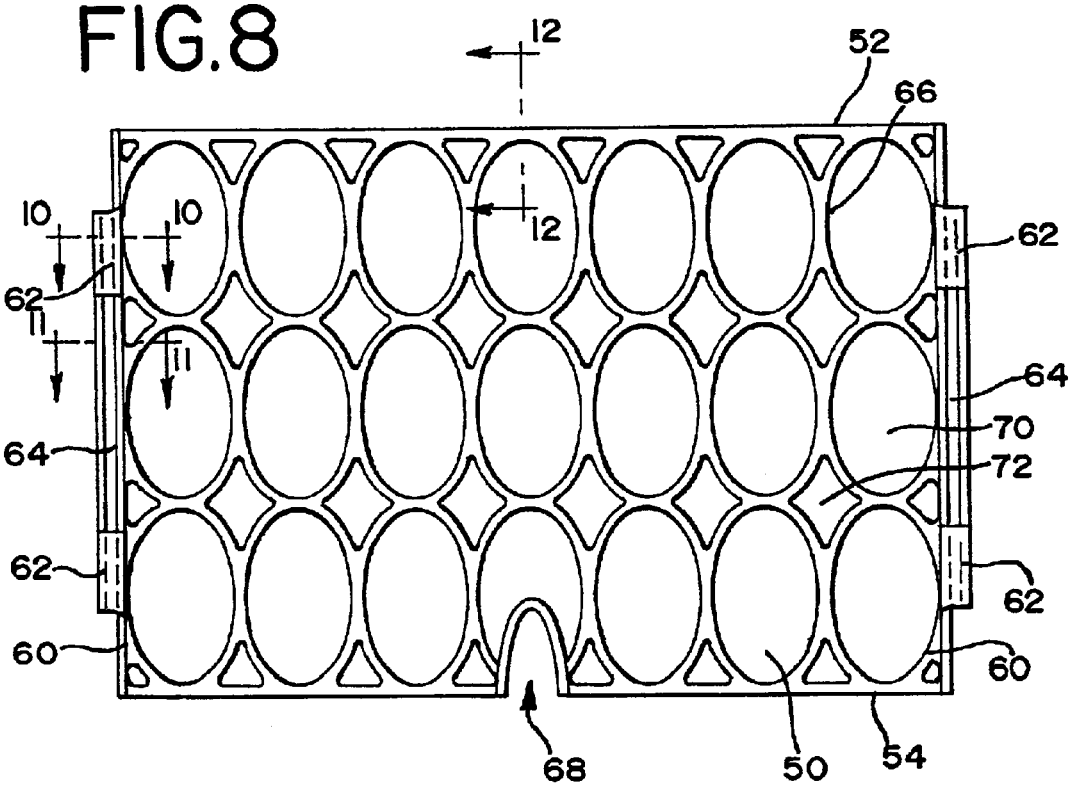
FIG. 8 is a front view of a back panel.
Figure 10:
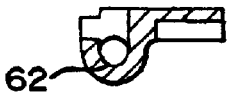
FIG. 10 is a partial cross-sectional view of the back panel taken along line 10—10 of FIG. 8.
Figure 11:
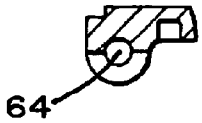
FIG. 11 is a partial cross-sectional view of the back panel taken along line 11—11 of FIG. 8.
Figure 12:
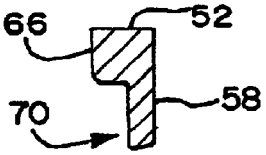
FIG. 12 is a partial cross-sectional view of the back panel taken along line 12—12 of FIG. 8.
Figure 14:
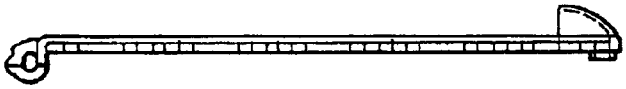
FIG. 14 is a top view of the front panel shown in FIG. 13.
Figure 13:
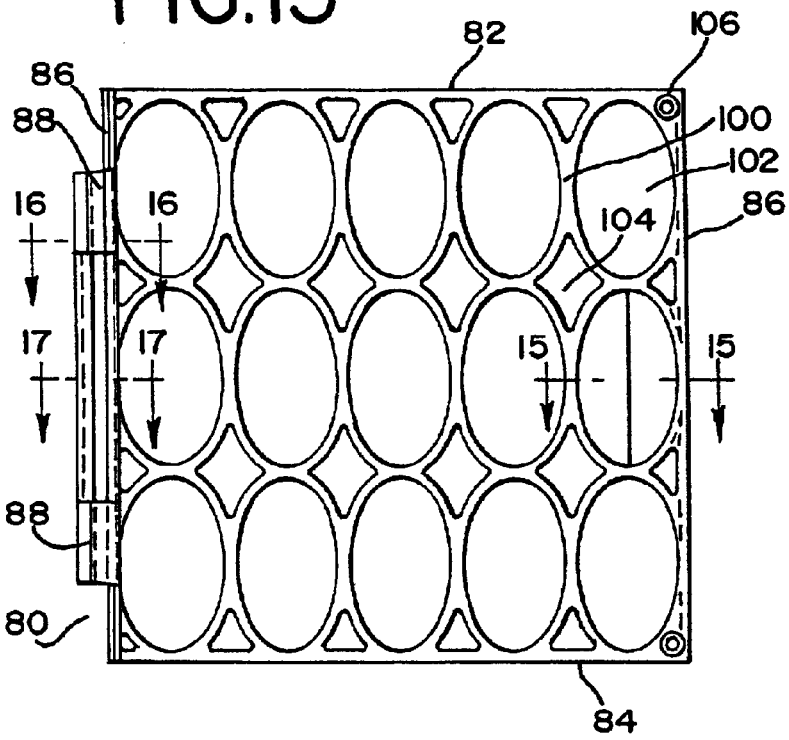
FIG. 13 is rear view of a front panel.
Figure 18:
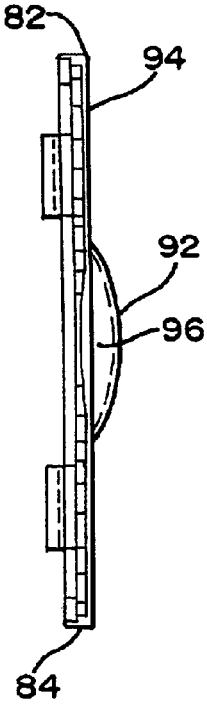
FIG. 18 is an end view of the front panel shown in FIG. 13.
Figure 15:
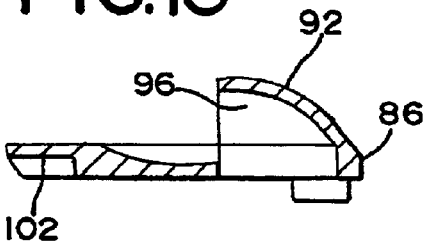
FIG. 15 is a partial cross-sectional view of the front panel taken along line 15—15 of FIG. 13.

Referring to FIGS. 3–7, in one embodiment of the side panel, the back 38 thereof includes a pair of lugs 46 formed along an inboard edge 47 of the back panel section. The term "lug" as used herein is meant to be interpreted broadly as including any sleeve, loop, hook, ring, protuberance or other structural configuration capable of engaging a shaft, rod or other post type member, whether alone or in combination with one or more adjacent staggered lugs. The lugs 46 are preferably formed by bending or forming a portion of the side panel into a loop to form the sleeve and opening. The side panel 30 also includes a pair of lugs 48 formed along a front edge 49 thereof, with the lugs again preferably formed from a portion of the panel and having coaxially aligned openings. In addition, the front 36 of the side panel include a curved region 45, which again increases the structural rigidity of the side panel and is resistant to buckling and/or bending. Referring to FIGS. 3, 4 and 6, a plurality of bosses (shown as four), each having a hole 41 therethrough, protrude inwardly from the side panel section.

Figure 21:
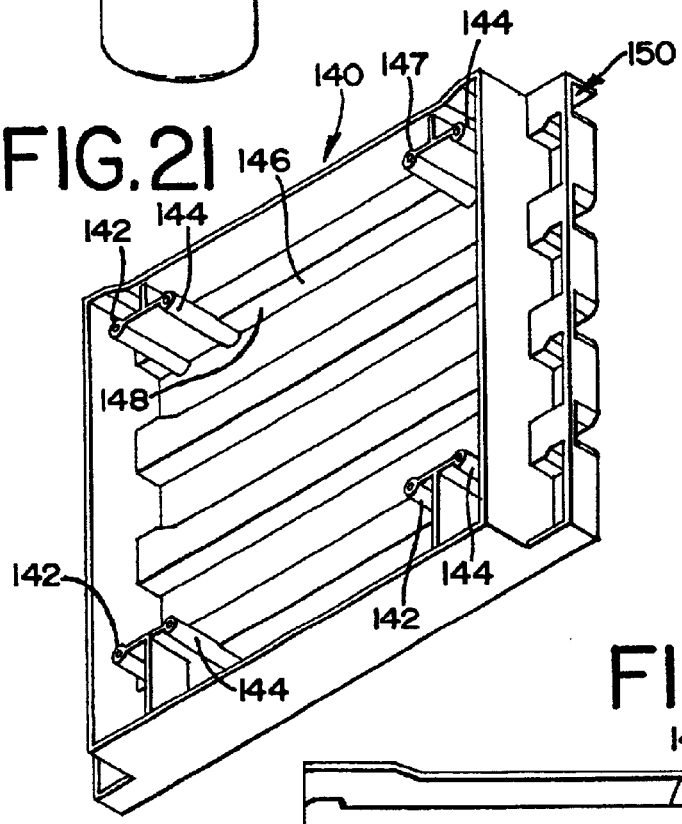
FIG. 21 is a backside perspective view of a drawer guide.
Figure 22:
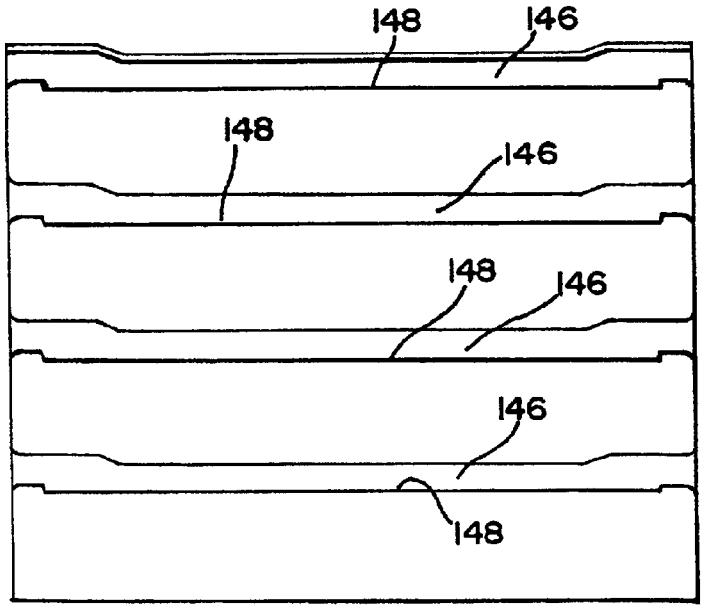
FIG. 22 is a frontside perspective view of the drawer guide.
Figure 23:
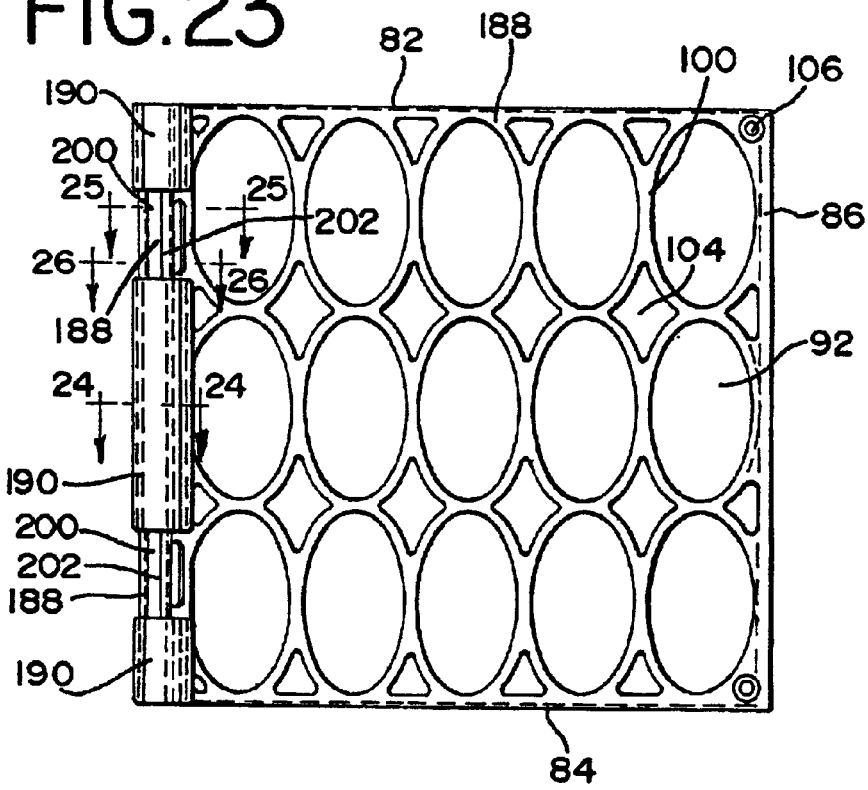
FIG. 23 is a rear view of an alternative embodiment of a front panel.
Figure 24:
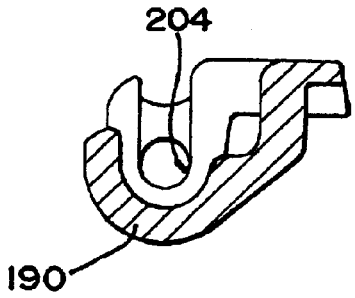
FIG. 24 is a partial cross-sectional view of the front panel taken along line 24—24 of FIG. 23.
Figure 26:
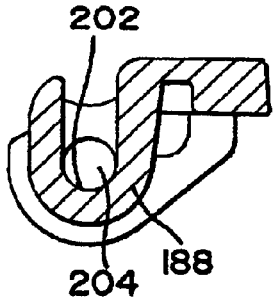
FIG. 26 is a partial cross-sectional view of the front panel taken along line 26—26 of FIG. 23.
Figure 25:
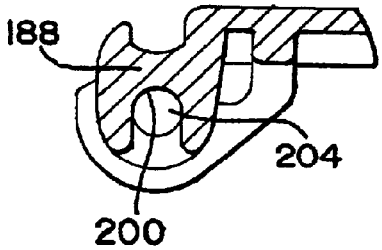
FIG. 25 is a partial cross-sectional view of the front panel taken along line 25—25 of FIG. 23.

Various rails and/or drawers can be secured to the bosses. For example, referring to FIG. 21, a drawer guide 140 is shown as including four pairs of lugs 142, 144. The front or back lugs of each pair can be aligned with the holes in the side panel, with fasteners securing the drawer guide to the side panel. Referring to FIGS. 21 and 22, the drawer guide defines a plurality of channels 146 forming a plurality of rails 148 extending from a front to a back thereof, with the channels open 150 to the front of the drawer guide. File folder hangers and drawers can be inserted in the channels and supported on the rails. The drawer guide is preferably made of a polypropylene, structural foam material, although it should be understood that it could also be made of metal, e.g. by stamping, or other molded plastics.

In an alternative embodiment, shown in FIG. 2, the side panel further includes a middle third support lug 148 or sleeve formed along the front edge 49 thereof. The third sleeve 148 has an opening therethrough that is aligned with the openings in the sleeves 48. The upper and lower support lugs 48 are each spaced from the middle support lug 148 so as to form two openings therebetween respectively.

In either embodiment, the bottom 34 of the side panel 30 is disposed and supported on an upper surface of the lower shelf. A bottom surface 28 of the next upper shelf 12 is then disposed and supported on a top 32 of the side panels.

As best shown in FIGS. 2 and 8–12, the back panel 50 is preferably generally rectangular in shape and has a top 52, a bottom 54 and opposite side edges 50. The back panel 50 extends between the back panel sections 40 of the side panel and is connected thereto with a pair of tie members 110. The back panel includes a pair of lugs 62 formed along each of the opposite side edges thereof. The lugs 62 are formed as a rearwardly facing hook, having an inner diameter shaped to receive the tie member 110. The back panel further includes an inwardly facing trough portion 64, or lug, that is staggered with and runs along the side edge between the lugs 62. The trough 64 has an inner diameter shaped to receive the tie member. The staggered lugs 62, 64 form an opening therebetween when viewed from a top of the panel. The lugs 62 of the back panel are spaced from the top and bottom 52, 54 of the back panel respectively such that they are disposed between and form openings that are coaxially aligned with the pairs of lugs 46 formed along the back of the side panels.

The back panel preferably includes an arch-shaped opening 68 formed along a bottom 54 thereof. The opening 68 provides an ideal location to pass electrical lines, cables and other wiring or utilities from inside the storage unit to a backside thereof. The back panel 50 is preferably made of a hard plastic material, and more preferably of an ABS thermoplastic material, although it should be understood that it could be made of plastics and of other materials, such as metal or wood. The back panel is preferably translucent, but can alternatively be made transparent or opaque. The back panel is preferably molded with a plurality of ribs 66 that form elliptical, triangular, and diamond shaped recesses 70, 72 therebetween. The ribs increase the structural rigidity and strength of the back panel.

Figure 16:
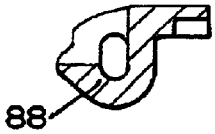
FIG. 16 is a partial cross-sectional view of the front panel taken along line 16—16 of FIG. 13.
Figure 17:
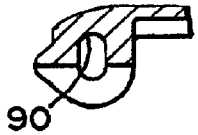
FIG. 17 is a partial cross-sectional view of the front panel taken along line 17—17 of FIG. 13.

As best shown in FIGS. 13–18, a pair of front panel 80, or doors, are shown. The front panel 80 is preferably symmetrical and can be used interchangeable on the left and right side of the storage unit. Each front panel 80 is preferably generally rectangular in shape and has a top 82, a bottom 84 and opposite side edges 86. The front panels, in combination, extend between the fronts 36 of the side panels and are connected thereto with a pair of tie members 110. Each front panel 80 includes a pair of lugs 88 formed along one side edge thereof. The lugs 88 are preferably formed as a forwardly facing hook, having an inner diameter shaped to receive the tie member. The front panel 80 further includes a rearwardly facing trough portion 90, or lug, that is staggered with and runs along the side edge 86 between the lugs 88. The trough 90 has an inner diameter shaped to receive the tie member. As shown in FIGS. 16 and 17, the trough 90 and the hook 88 form an opening therebetween, which is shaped to receive the tie member, when viewed from a top of the panel. In essence, the lugs 48, 88 of the front and side panels form a hinge, which is connected with a hinge pin 110.

The front panel preferably includes a one-half dome shaped handle 92 that extends from a front 94 of the panel along a side opposite the lugs. The handle 92 forms an opening 96 in which a finger can be inserted for gripping by a user. The front panel is preferably made of a hard plastic material, and more preferably an ABS thermoplastic material, although it should be understood that it could be made of other materials, such as metal or wood, and other plastics. As with the back panel, the front panels also are preferably translucent, but can alternatively be made transparent or opaque. The front panel 80 is preferably molded with a plurality of ribs 100 that form elliptical, triangular and diamond shaped recesses 102, 104 therebetween. The ribs 100 increase the structural rigidity and strength of the front panel. A pair of bosses 106 extend rearwardly from the front panel at a top and bottom corner thereof along the side of the front panel opposite the lugs. A magnetic catch 104 is attached to one of the bosses on each front panel, and preferably to the uppermost boss. As shown in FIG. 2, a strike plate 106 is attached to the bottom 28 of the upper shelf 12. In operation, the catch 104 magnetically engages the strike plate 106 to maintain the front panel in a closed position. It should be understood that other non-magnetic, e.g. snap-fit, catches could also be used.

In an alternative embodiment of the front panel, shown in FIGS. 2 and 23–26, the front panel 180 includes a pair of lugs 188 or sleeves dimensioned to receive the tie member 110, and an outwardly facing trough 198 running along the side edge of the front panel above, below, and between the lugs 188. The trough 190 has an inner diameter dimensioned to receive and pivot about the lugs or sleeves 48, 148 extending from the side panel, with the lugs 188 disposed in the space formed between the lugs 48, 148 and with the openings therethrough being coaxially aligned. The lugs 188 include a forwardly facing channel portion 200 and a rearwardly facing channel portion 202, each of which is dimensioned to receive and engage the tie member 110. The lugs 188, with their channel portions 200, 202 define an opening 204 therebetween when viewed from a top or bottom of the panel. When installed, the lugs 48, 148, 188 form a hinge, which is connected with the tie member 110, which serves as a hinge pin.

As shown in FIG. 1, the storage unit 10 can be assembled with our without front panels 80, 180 depending on the desired configuration. In addition, it should be understood that a single front panel that extends across the entirety of the width of the storage unit between the opposite side panels could also be used, with the front panel being pivotably attached to only one of the side panels. In such an embodiment, the strike plate 106, or other catch device, would be moved from a center position to a side position so as to be aligned with a magnetic catch positioned adjacent an edge of the front panel.

Figure 19:
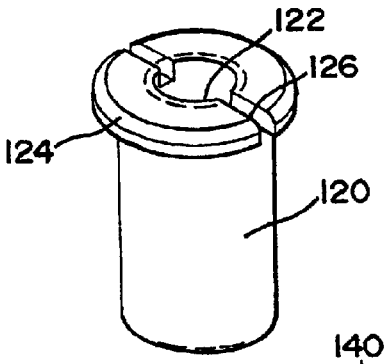
FIG. 19 is a perspective view of an insert.
Figure 20:
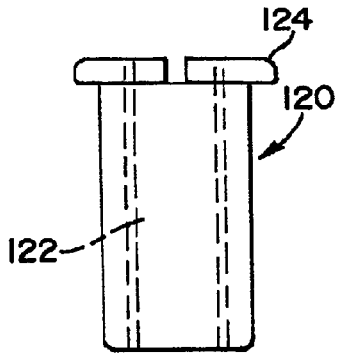
FIG. 20 is a side view of the insert shown in FIG. 19.

To assemble the storage unit, a plurality of tie members 110 and insert members 120 are used. Each tie member 110 is preferably made of steel and includes opposite threaded ends 112. The tie members are preferably configured as a cylindrical shaft, on the rod, so as to serve as a hinge pin for the front panel. The insert members 120 are preferably configured as barrel nuts, shown in FIGS. 19 and 20, each of which has a threaded opening 122 or bore extending therethrough wherein the insert member can be threadably engaged from either or both ends thereof. One end of the barrel nut includes a circumferential flange 124 and a groove 126 formed in the flange and extending diametrically across the end of the barrel nut. In operation, as shown in FIG. 2, a plurality of insert members 120 are inserted into the openings 14 formed in the lowermost shelf member, with the circumferential flange 124 engaging a bottom of the shelf. In a preferred embodiment, the openings 14 are countersunk 16 so as to provide a recess for the flange 124 such that it does extend beyond the bottom surface of the shelf member.

The side panels 30 are next supported on the upper surface of the lowermost shelf member 12, with the back panel 50 extending between the back sections 40 of the side panels. The bottom lugs 62 of the back panels rest on the bottom lugs or sleeves 46 of the side panels, with the openings of the lugs in coaxial alignment. A tie member 110 is inserted through the openings defined by the lugs 46, 62, 64, which act as securing members, and is threadably engaged with the insert member 120 in the lowermost shelf. The tie member 110 is engaged between the trough 64 and the lugs 62 on the back panel, which act as securing members, and extends through the lugs or sleeves 46 on the side panels 30.

Each of the front doors are then positioned with the lugs 88, 90, 188, 190 thereof, and the openings defined thereby, and the openings defined thereby, coaxially aligned with the lugs 48, 148 of the side panels and the openings defined thereby. In a first embodiment, a tie member 110 extends through and/or is engaged with the lugs 88, 48, 90 of the front door, and the side panel, which act as securing members, and is threadably engaged with the insert member 120 in the lower shelf. The lugs 48, 88, 90 in combination with the member 110 inserted therethrough form a hinge. In particular, the tie member 110 is engaged between the trough 90 and the lugs 88, which act as securing members.

In the alternative preferred embodiment of the front panel 180, the trough 190 pivots about the lugs 48, 148 of the side panel. At the same time, the tie member 110 extends through and/or is engaged with the lugs 188, 48, and 148 of the front and side panels, which act as securing members, and is threadably engaged with the insert member 120 in the lower shelf. The lugs and trough 48, 148, 188, 190, in combination with the member 110 inserted therethrough, form a hinge.

In either embodiment, each front door 80, 180 is pivotably or hingedly mounted about the tie member 110 and is thereby connected to the side panel 30. Preferably, the lugs 48, 148, 88, 90, 188 or securing members of the side and front panels are arranged such that the bottom 84 of the front panel is spaced slightly above the upper surface of the lowermost shelf member.

The upper shelf member 12 is disposed on the side panels 30, with a bottom 28 of the shelf member being supported on a top 32 of the side panels, and preferably only by the top of the side panels. An insert member 120 is inserted into each opening of the upper shelf, with the flange 124 received in a countersink 116 formed in the upper surface 29 of the shelf member. The insert members 120 are threadably engaged with the upper end 112 of the tie member. A tool, such as screwdriver, can be engaged with the groove 126 formed on the head of the barrel nut to tighten the insert member and thereby put the tie members 110 in tension, with the side panels 30 clamped between the shelf members 12 in compression.

Additional levels of storage can be easily added without having to disassemble the existing storage unit, regardless of whether it is already one or more levels. Rather, a pair of side panels 30 are simply disposed on the upper surface 29 of the uppermost shelf member 12 of the existing storage unit. A back panel 50 is then positioned between the side panels 30. If desired, one or more front panels 80 can be positioned between a front of the side panels. Tie members 110 are then engaged by the securing members of the respective panel members and are threadably engaged with a top of the insert members 120 recessed in the countersink of the uppermost shelf member of the existing storage unit. Since the insert members 120 are threaded all of the way through, they serve both as tightening member for the lower tie members and as a nut for the upper tie members.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A storage unit kit having components capable of being assembled into a storage unit, the kit comprising:

first, second and third shelf members, wherein each of said shelf members has an opening extending therethrough and comprises a threaded insert disposed in said opening, wherein said threaded insert comprises a threaded bore extending therethrough and open to both sides of a corresponding one of said shelf members, wherein said insert is capable of being threadably engaged from opposite ends thereof;

a plurality of side panels, at least two of said plurality of side panels are adapted to be supported on each of said first and second shelf members, with said second and third shelf members supported on said at least two of said plurality of side panels supported on each of said first and second shelf members respectively;

at least one back panel adapted to extend between said at least two of said plurality of side panels supported on at least one of said first and second shelf members;

a plurality of tie members adapted to extend between and connect said first and second shelf members and said second and third shelf members with said at least two of said plurality of side panels clamped therebetween respectively; and at least one front panel adapted to be connected to at least one of said plurality of side panels;

wherein each of said plurality of side panels, back panels and front panels comprises a securing member adapted to engage at least one of said tie members, and wherein said securing members on said plurality of side panels and said back and front panels are arranged along a length thereof respectively such that they are staggered relative to each other with openings formed thereby in coaxial alignment when said storage unit is assembled.

2. A storage unit comprising:

a first and second horizontal shelf member;

a pair of side panels disposed between said first and second horizontal shelf members, wherein each side panel comprises a bottom, a top, a front and a back, wherein said bottom of each of said side panels is supported by said first shelf member and wherein said second shelf member is supported on said tops of said side panels, and wherein each of said side panels comprising a securing member disposed along said front and back thereof; a back panel having opposite sides and comprising a securing member along each of said sides thereof, wherein said back panel extends between said side panels with said securing members of said back panel aligned with said securing members on said backs of said side panels;

a front panel having opposite sides and comprising a securing member disposed along at least one of said sides thereof, wherein said securing member of said front panel is aligned with said securing member on the front of one of said side panels;

a first and second tie member engaging said aligned securing members of said back panel and said side panels on each side of said back panel, and a third tie member engaging said aligned securing members of said front panel and said side panel, said first, second and third tie members connecting said first and second horizontal shelf members with said side panels clamped therebetween;

a third horizontal shelf member;

a second pair of side panels disposed between said second and third horizontal shelf members, wherein each of said second pair of side panels comprises a bottom, a top, a front and a back, wherein said bottom of each of said second pair of side panels is supported by said second shelf member and wherein said third shelf member is supported on said tops of said second pair of side panels, and wherein each of said second pair of side panels comprises a securing member disposed along said front and back thereof;

a second back panel having opposite sides and comprising a securing member disposed along each of said sides thereof, wherein said second back panel extends between said second pair of side panels with said securing members of said back panel aligned with said securing member on said backs of said second pair of side panels;

a second front panel having opposite sides and comprising a securing disposed along at least one of said sides thereof, wherein said securing member of said front panel is aligned with said securing member on the front of one of said second pair of side panels;

a fourth and fifth tie member engaging said aligned securing members of said second back panel and said second pair of side panels on each side of said second back panel, and a sixth tie member engaging said aligned securing members of said second front panel and said one of said second pair of side panels, said fourth, fifth and sixth tie members connecting said second and third horizontal shelf members with said second pair of side panels clamped therebetween.

3. The storage unit of claim 2 wherein said first and second shelf members each comprise a plurality of inserts threadably engaged with opposite ends of said first, second and third tie members.

4. The storage unit of claim 3 wherein said fourth, fifth and sixth tie members are threadably engaged with said plurality of inserts in said second shelf member.

5. The storage unit of claim 4 wherein said third shelf member comprise a plurality of inserts threadably engaged with said fourth, fifth and sixth tie members.

6. The storage unit of claim wherein said front panel comprises a pair of first front panels each having a securing member disposed along one side thereof, wherein said securing members of said pair of first front panels are aligned with said securing members on the front of said side panels, and further comprising a seventh tie member engaging said aligned securing members of one of said pair of said first front panels and one of said side panels, said seventh tie member connecting said first and second horizontal shelf members with said side panels clamped therebetween, and wherein said pair of said first front panels are pivotable about said third and seventh tie members respectively.

7. The storage unit of claim 2 wherein said back of each of said side panels comprises a back panel section extending substantially perpendicular to a side panel section of said side panel, and wherein said securing member disposed along said back are disposed along an inboard edge of said back panel section.

* * * * *